US005642570A

United States Patent [19]

Lee

[11] Patent Number: 5,642,570

[45] Date of Patent: Jul. 1, 1997

[54] STRUCTURE OF HAIR DRIER

[76] Inventor: Tzung Sheng Lee, 1F, No. 20, Kang Shen Rd., Beei Tou District, Taipei, Taiwan

[21] Appl. No.: 629,545

[22] Filed: Apr. 9, 1996

[51] Int. Cl.[6] ..... A45D 20/12; A45D 20/08

[52] U.S. Cl. ..... 34/98

[58] Field of Search ..... 34/96, 97, 98, 34/91; 132/272

[56] References Cited

U.S. PATENT DOCUMENTS

| | | | |
|---|---|---|---|
| 3,889,693 | 6/1975 | Tanaka et al. | 132/272 |
| 3,905,379 | 9/1975 | Churas et al. | 132/272 |
| 3,947,659 | 3/1976 | Ono | 34/97 X |
| 4,114,022 | 9/1978 | Braulke, III | 34/97 X |
| 4,166,473 | 9/1979 | Bauer et al. | 132/272 |
| 4,523,080 | 6/1985 | Bolton | 34/97 X |
| 4,605,019 | 8/1986 | Reynolds et al. | 132/272 |
| 4,834,121 | 5/1989 | Bell | 132/272 |
| 5,339,540 | 8/1994 | Edwards | 34/97 |

FOREIGN PATENT DOCUMENTS

| | | |
|---|---|---|
| 3822104 | 2/1989 | Germany . |
| 47-20694 | 2/1972 | Japan . |
| 47-20695 | 2/1972 | Japan . |

*Primary Examiner*—John M. Sollecito
*Assistant Examiner*—Steve Gravini
*Attorney, Agent, or Firm*—Morton J. Rosenberg; David I. Klein

[57] ABSTRACT

A hair drier which includes an elongated air passageway in the barrel thereof at the bottom side, the air passageway having a front end terminating in a water nozzle in front of the barrel and a rear end, a receptacle mounted in the barrel, a water container coupled to the receptacle and having a dip tube inserted into the receptacle in communication with the air passageway, a motor mounted in a handle at one end of the barrel, a piston coupled to the motor by a crank and reciprocated by it in the rear end of the air passageway to induce a liquid from the water container into the air passageway and to drive the liquid out of the air passageway through the water nozzle.

4 Claims, 6 Drawing Sheets

STRUCTURE OF HAIR DRIER

BACKGROUND OF THE INVENTION

The present invention relates to hair driers, and relates more particularly to such a hair drier which can be controlled to spray a mist of fine drops of water for moistening the hair.

A regular hair drier, as shown in FIG. 1, is generally comprised of a barrel, an electric heater mounted inside the barrel, and an air fan disposed behind the electric heater and controlled by a switch to cause a current of air toward the electric heater. When using this structure of hair drier to dry the hair, the hair tends to be damaged by hot air if it is not properly moistened.

SUMMARY OF THE INVENTION

The present invention has been accomplished to provide a hair drier which eliminates the aforesaid problem. It is the main object of the present invention to provide a hair drier which can be controlled to spray a mist of fine drops of water for moistening the hair when drying.

According to one embodiment of the present invention, the hair drier comprises an elongated air passageway in the barrel thereof at the bottom side, the air passageway having a front end terminating in a water nozzle in front of the barrel and a rear end, a receptacle mounted in the barrel at the bottom side, a water container coupled to the receptacle and having a dip tube inserted into the receptacle in communication with the air passageway, a motor mounted in a handle at one end of the barrel, a piston coupled to the motor by a crank and reciprocated by it in the rear end of the air passageway to induce a liquid from the water container into the air passageway and to drive the liquid out of the air passageway through the water nozzle. According to another embodiment of the present invention, the receptacle and the water container are installed in the handle of the hair driver on the inside, and therefore the water container is well protected.

DETAILED DESCRIPTION OF THE PREFERRED EMBODIMENT

Figure 1:
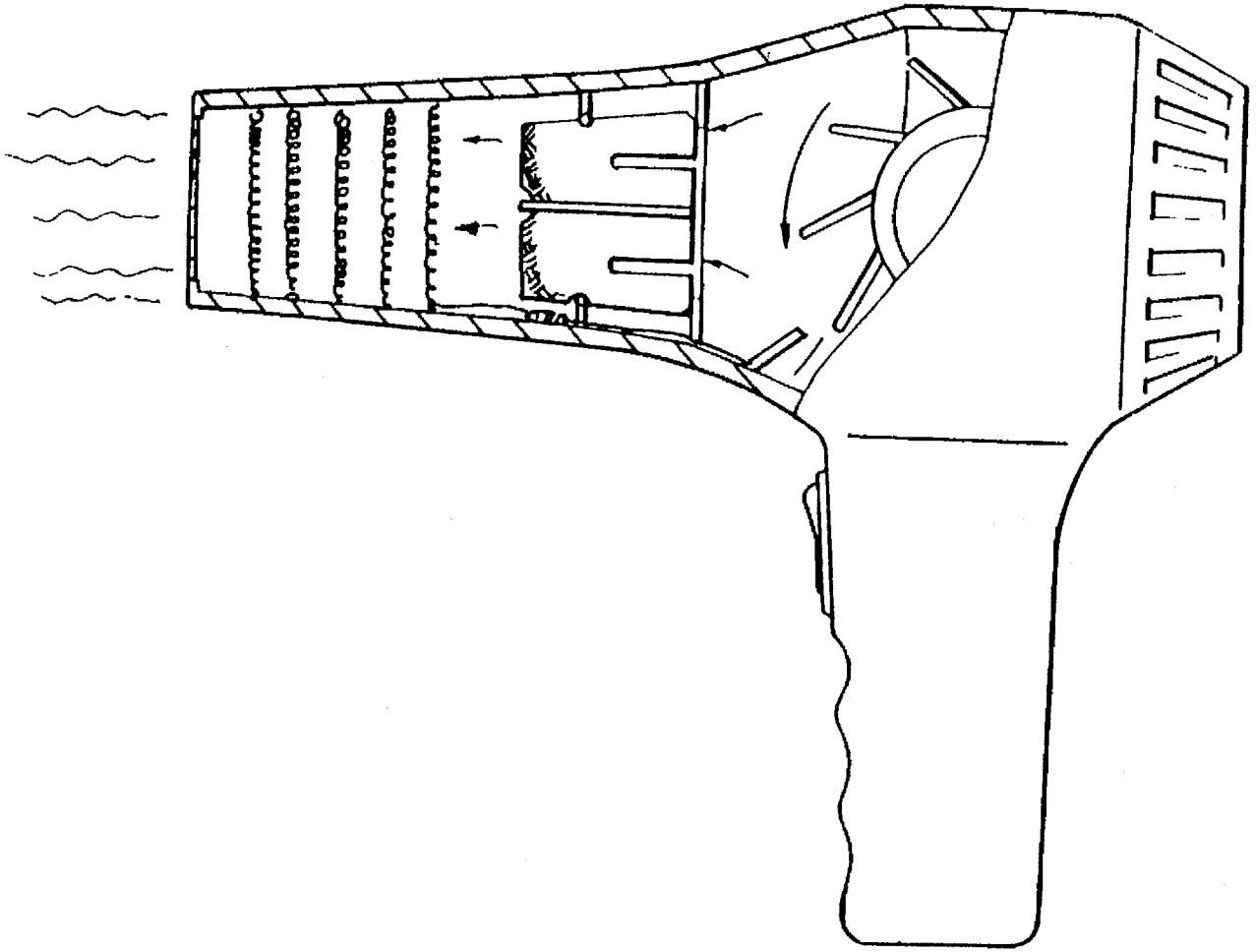
FIG. 1 is a cutaway view of a hair drier according to the prior art.
Figure 2:
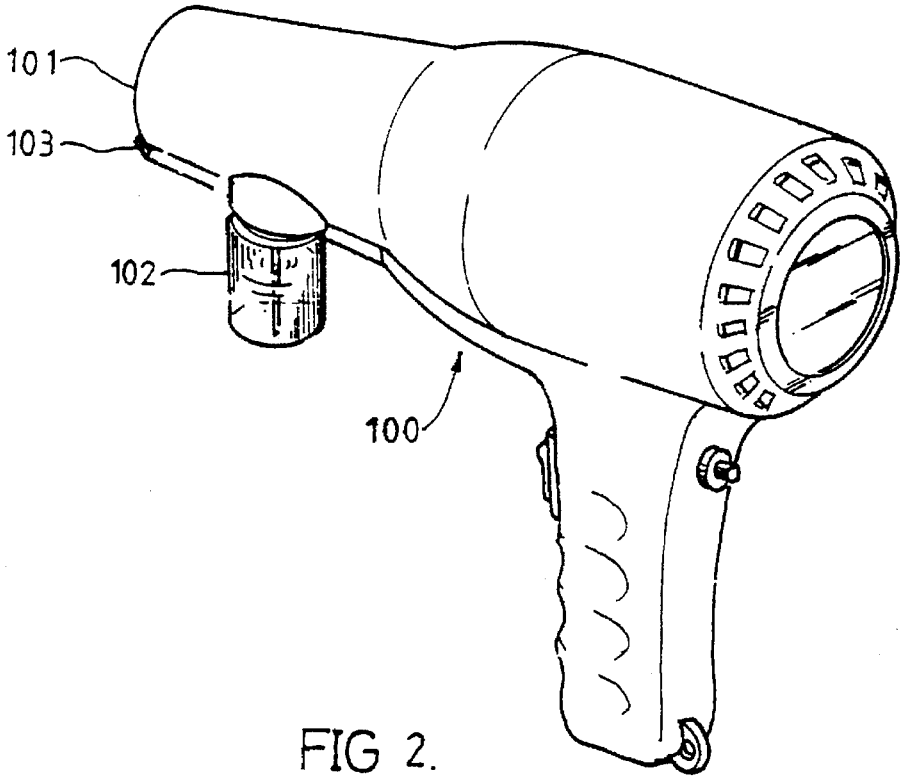
FIG. 2 is an elevational view of a hair drier according to one embodiment of the present invention.

Referring to FIG. 2, the hair drier, referenced by 100, has a detachable water container 102 connected to the barrel 101 at the bottom side. Water in the detachable water container 102 can be sucked in the barrel 101, then pumped outwards to a nozzle 103 at the front end of the barrel 101, and then ejected out of the nozzle 103, and therefore a mist of fine drops of water is sprayed over the hair to prevent the hair from being damaged by hot air.

Figure 3:
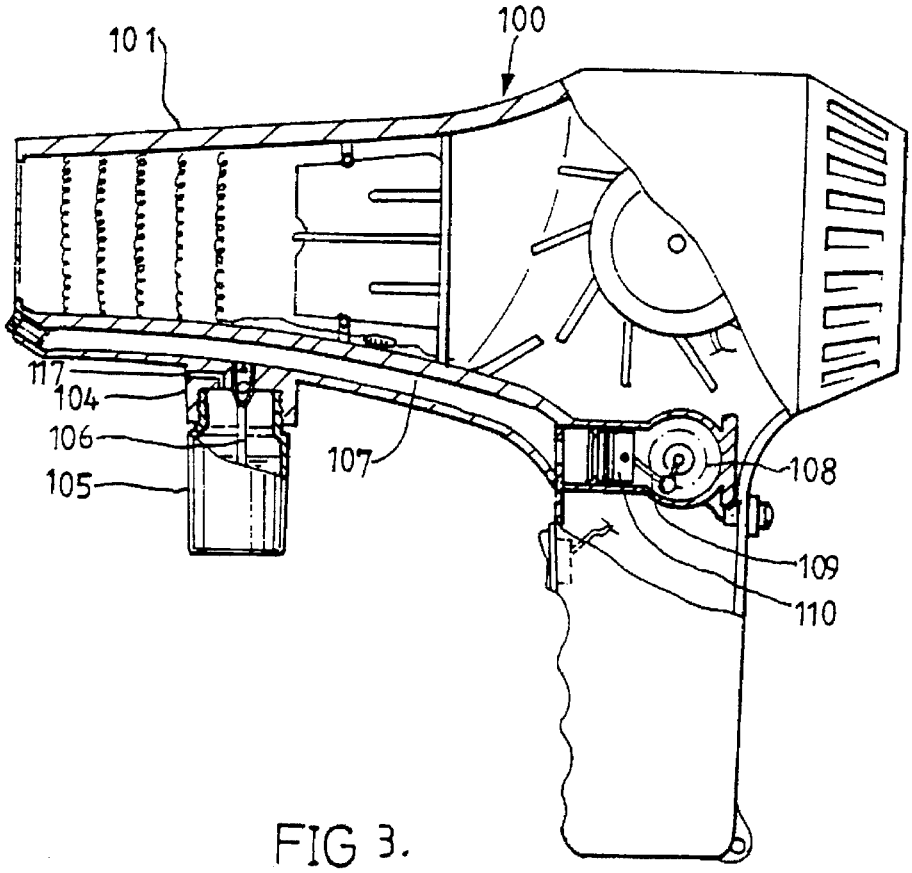
FIG. 3 is a cutaway view of the hair drier shown in FIG. 2.
Figure 4A:
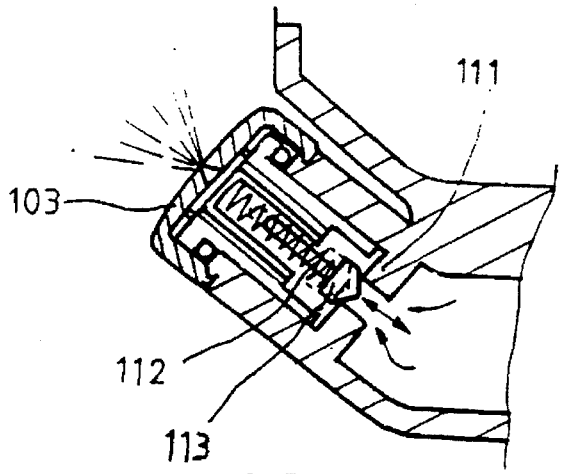
FIG. 4A is a sectional view in an enlarged scale of the nozzle at the front end of the hair drier shown in FIG. 2.
Figure 4B:
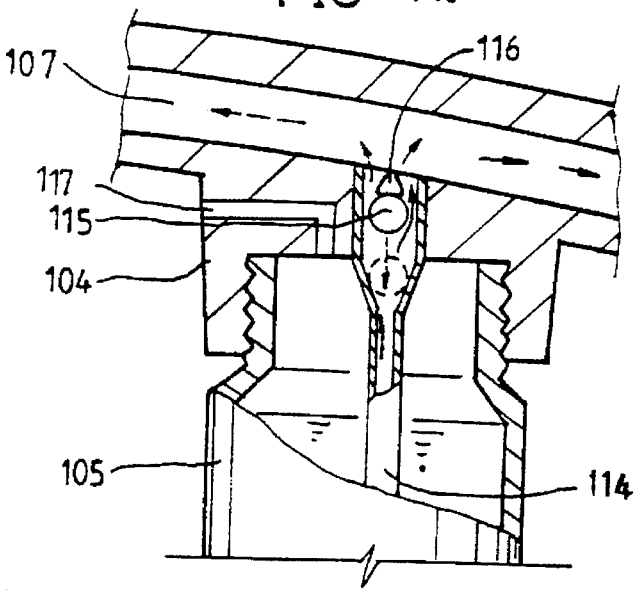
FIG. 4B is a sectional view in an enlarged scale of the water container and the receptacle at the bottom side of the barrel of the hair drier shown in FIG. 2.

Referring to FIG. 3, an internally threaded receptacle 104 is made on the barrel 101 of the hair drier 100 at the bottom side, and a detachable water bottle 105 is mounted in the receptacle 104. The detachable water bottle 105 is mounted with a dip tube 106, which has a top end connected to a longitudinal air passageway 107 at the bottom side of the barrel 101. A motor 108 is mounted inside the handle of the hair drier 100. A piston 110 is coupled to the motor 108 by a crank 109, and reciprocated in the air passageway 107 at one end. When the piston 110 is reciprocated in the air passageway 107 at one end, water is sucked in the air passageway 107 from the detachable water bottle 105 and then driven out of the nozzle 103. The nozzle 103, as shown in FIG. 4A is mounted on the front end of the barrel 101 at the bottom side, having an inside annular flange 111 at an inner side, a spring 112 mounted on the inside, and a stopper 113 forced backwards by the spring 112 into engagement with the inside annular flange 111 to stop the air passageway. The water bottle 105, as shown in FIG. 4B, is fastened to the internally threaded receptacle 104 at the bottom side of the barrel 101; the dip tube 114 is inserted into the detachable water bottle 105, having an expanded top end inserted through the receptacle 104 and connected to the air passageway 107, a steel ball 115 moved in the expanded top end, and a stop flange 116 at inside the expanded top end at the top to stop the steel ball 115 from escaping out of the dip tube 114 into the air passageway 107. When the steel ball 115 is moved upwards, the water passage between the detachable water bottle and the air passageway 107 is opened.

Figure 4C:
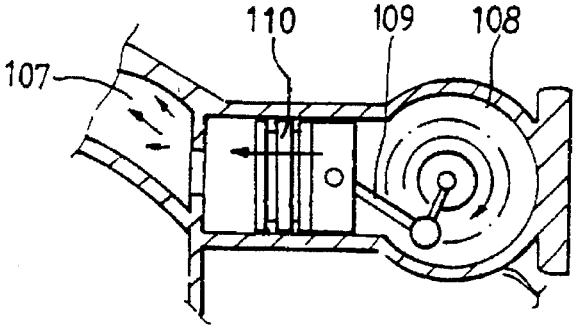
FIG. 4C is a sectional view in an enlarged scale of the motor, the crank, and the piston in the handle of the hair drier shown in FIG. 2.

Referring to FIG. 4C, when the motor 108 is started, the crank 109 is driven to reciprocate the piston 110 in the air passageway 107 at one end, thereby causing the piston 110 to induce air and to exhaust air alternatively.

Figure 5A:
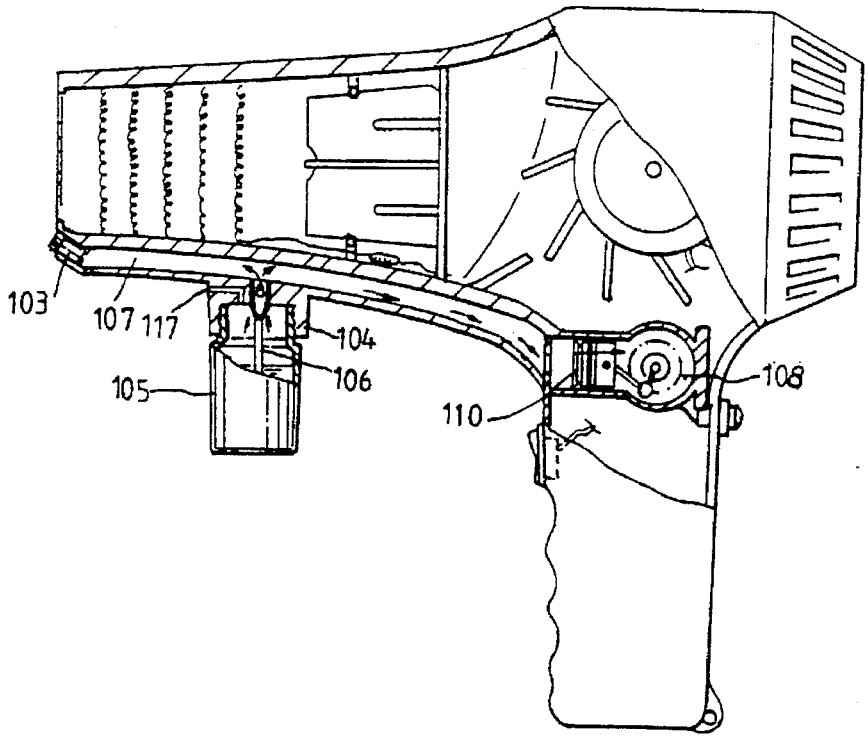
FIG. 5A is another cutaway view of the hair drier shown in FIG. 2, showing the induction stroke of the piston.
Figure 5B:
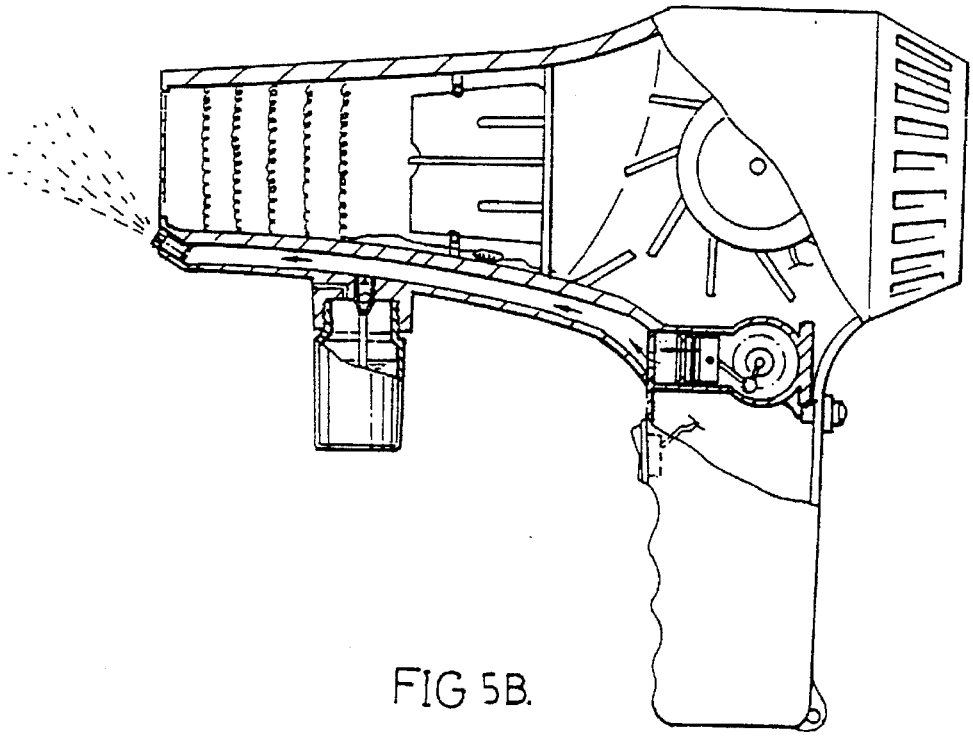
FIG. 5B is still another cutaway view of the hair drier shown in FIG. 2, showing the exhaust stroke of the piston.

Referring to FIGS. 5A and 5B, during the induction stroke of the piston 110, the air inside the air passageway 107 is at a negative pressure state, the stopper 113 of the nozzle 103 is forced by the spring 112 into engagement with the inside annular flange 113 to stop the air passageway 107, therefore outside air is prohibited from passing through the nozzle 103 to the inside of the air passageway 107 and, a suction force is produced in the detachable water bottle 105 to suck the steel ball 115 of the dip tube 106 upwards and to draw water from the detachable water bottle 105 into the air passageway 107 (see FIG. 5A); during the exhaust stroke of the piston 110, the air inside the air passageway 107 is at a positive pressure state, the steel ball 115 is forced downwards by air pressure to stop the passage between the detachable water bottle 105 and the air passageway 107 to prevent reverse flow of water, the stopper 113 is forced outwards to compress the spring 112 and to let water be driven out of the air passageway 107 through the nozzle 103.

Figure 6A:
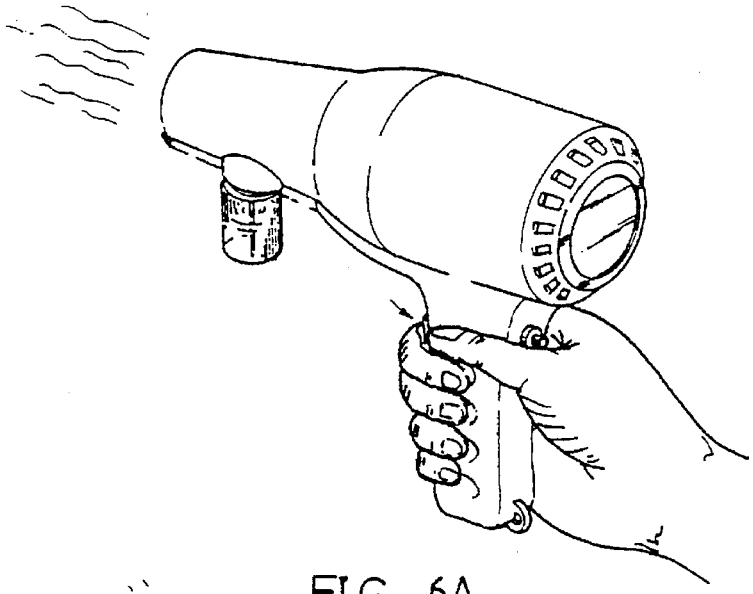
FIG. 6A is an applied view of the present invention, showing a current of hot air driven out of the barrel.
Figure 6B:
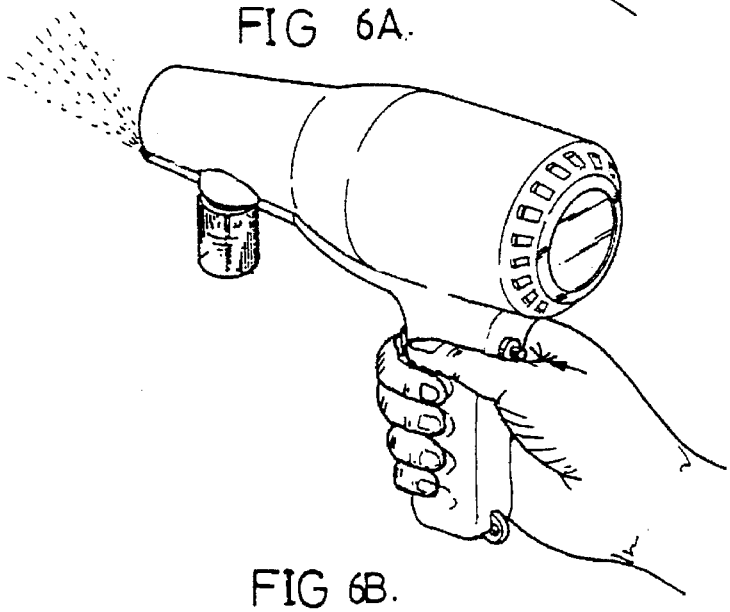
FIG. 6B is another applied view of the present invention, showing a mist of fine drops of water driven out of the barrel.
Figure 6C:
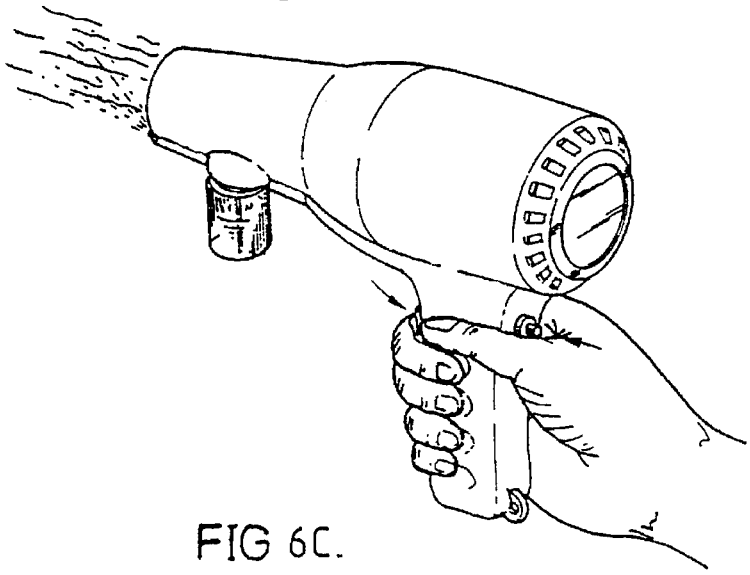
FIG. 6C is still another applied view of the present invention, showing a current of hot air and a mist of fine drops of water driven out of the barrel.

Referring to FIGS. 6A, 6B, and 6C, when the switch at the front side of the handle of the air drier is switched on, the air drier produces a current of hot air for drying the hair (see FIG. 6A); when the switch at the back side of the handle of the hair drier is switched on, a mist of fine drops of water is driven out of the front end of the hair drier to moisten the hair (see FIG. 6B); when both switches are switched on, the current of hot air and a mist of fine drops of water are simultaneously driven out of the front end of the hair drier (see FIG. 6C). Hair lotion, nutrient solution, hair style setting solution may be filled in the detachable water bottle instead of water for treating the hair.

Figure 7:
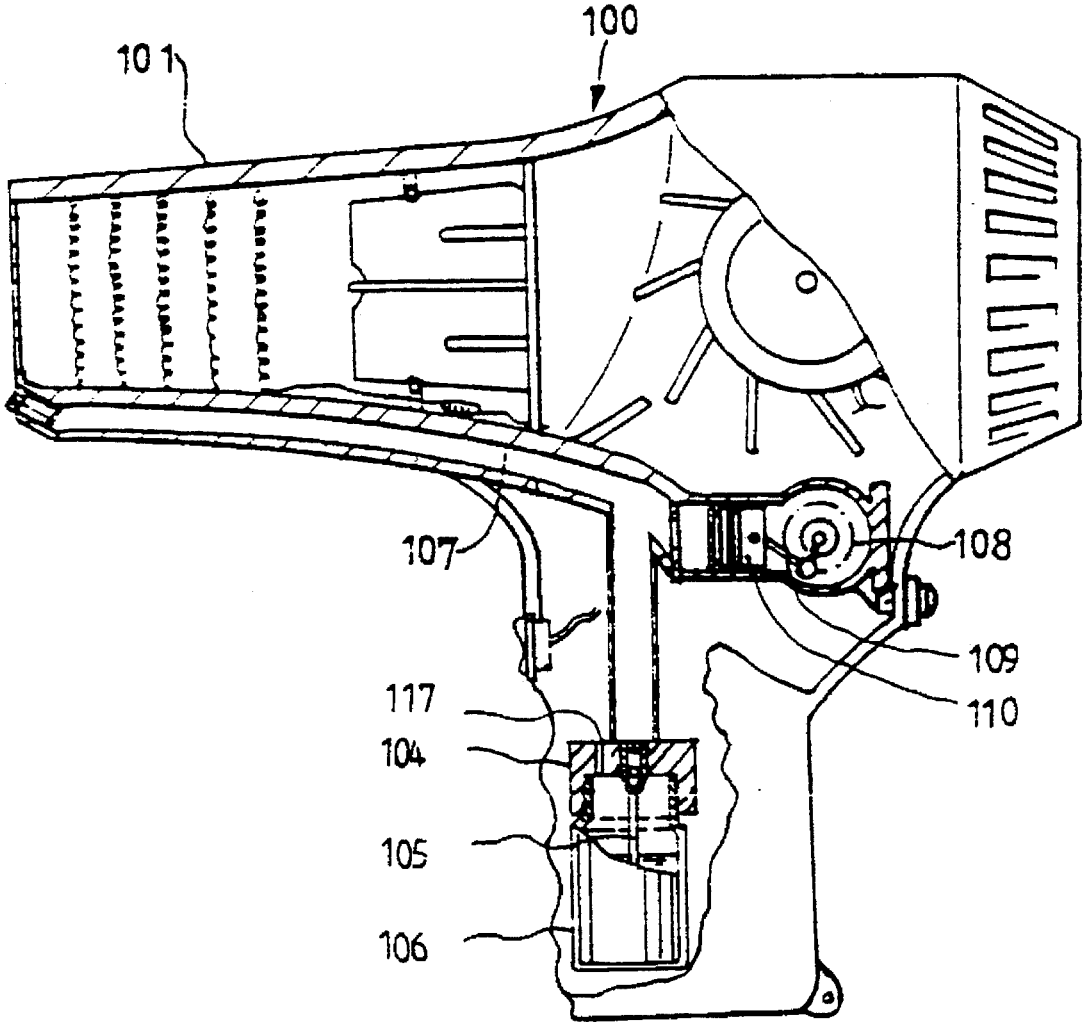
FIG. 7 is a cutaway view of an alternate form of the present invention, showing the receptacle and the detachable water bottle installed in the handle on the inside.

FIG. 7 shows an alternate form of the present invention, in which the receptacle 104 and the detachable water bottle 105 are installed in the handle of the hair drier 100; the air passageway 107 has a rear end curved downwards to the receptacle 104; when the motor 108 is started, the piston 110 is reciprocated by the crank 109, thereby causing a flow of water to be induced from the detachable water bottle 105 into the air passageway 107 and then driven out of the air passageway 107 through the nozzle 103. Because the receptacle 104 and the detachable water bottle 105 are mounted inside the handle of the hair drier, the detachable water bottle 105 is well protected.

It is to be understood that the drawings are designed for purposes of illustration only, and are not intended as a definition of the limits and scope of the invention disclosed.

What the invention claimed is:

1. An electric hair drier for expelling a stream of heated air and a mist of a liquid composition comprising:

(a) a barrel portion having formed therein a heat stream passageway for the expulsion of said heated air stream there through;

(b) a conduit portion coupled to said barrel portion defining an elongate air passageway external to said heat stream passageway for the passage of said liquid composition therethrough, said conduit portion having an outlet end;

(c) a liquid container detachably coupled to said conduit portion for storing therein said liquid composition, said liquid container having a dip tube for the passage of said liquid composition between said liquid container and said air passageway;

(d) automatic pump means coupled to said conduit portion adapted for pumping said liquid composition through said air passageway, said automatic pump means including a piston member and a motor for imparting reciprocating motion to said piston member; and, (e) a nozzle assembly coupled to said conduit portion adjacent said outlet end thereof for the pressurized expulsion of said liquid composition therethrough, said nozzle assembly having defined therein an inner chamber adapted for communication with said air passageway of said conduit portion, said nozzle assembly including resiliently biased valve means for selectively blocking said communication between said inner chamber and said air passageway responsive to said automatic pump means.

2. The electric hair drier as recited in claim 1 including a handle portion coupled to said barrel portion, said handle portion housing said liquid container.

3. The electric hair drier as recited in claim 1 wherein said automatic pump means includes spray actuation means coupled to said motor thereof adapted to actuate said motor independent of said generation and expulsion of said heated air stream.

4. The electric hair drier as recited in claim 1 wherein said nozzle assembly is adapted for the pressurized expulsion therethrough both of a first liquid composition characterized by a first predetermined viscosity and of at least a second liquid composition characterized by a second predetermined viscosity, said second predetermined viscosity being greater than said first predetermined viscosity.

* * * * *